US009754436B1

(12) United States Patent
Drasinover

(10) Patent No.: US 9,754,436 B1
(45) Date of Patent: Sep. 5, 2017

(54) BANKNOTE CASH UNIT

(71) Applicant: MASTERWORK AUTOMODULES TECHNOLOGY CORP., LTD., Taipei (TW)

(72) Inventor: Julije Drasinover, Taipei (TW)

(73) Assignee: MASTERWORK AUTOMODULES TECHNOLOGY CORP., LTD., Taipei (TW)

( * ) Notice: Subject to any disclaimer, the term of this patent is extended or adjusted under 35 U.S.C. 154(b) by 0 days.

(21) Appl. No.: 15/213,408

(22) Filed: Jul. 19, 2016

(51) Int. Cl.
*G07D 11/00* (2006.01)
*G07F 19/00* (2006.01)

(52) U.S. Cl.
CPC ..... *G07D 11/009* (2013.01); *G07F 19/201* (2013.01)

(58) Field of Classification Search
CPC .... B65D 33/1961; B65D 33/14; B65D 33/20; G07D 11/009; G07D 11/0006; G07D 11/0009; G07F 19/201; E05G 1/026; B65H 31/18; B65H 31/22; B65B 25/14; B65B 7/02
USPC ..... 232/1 D, 15, 16, 43.2; 271/213, 218; 902/9; 194/206, 350; 109/66, 75; 383/211; 53/477, 235
See application file for complete search history.

(56) References Cited

U.S. PATENT DOCUMENTS 7,059,599 B2 * 6/2006 Lewis ..... G07D 11/0009 109/22
7,850,165 B2 * 12/2010 Nagura ..... B65H 31/18 271/177
9,045,309 B2 6/2015 Hashimoto
9,266,693 B2 * 2/2016 Hashimoto ..... B65H 31/22
9,466,167 B2 * 10/2016 Razzaboni ..... B65B 25/14
2010/0230231 A1 * 9/2010 Uesaka ..... G07D 9/02 194/206
2013/0213763 A1 * 8/2013 Rao ..... G07D 11/0069 194/350
2014/0254960 A1 9/2014 Tanaike
2015/0083792 A1 * 3/2015 Bullock ..... G07D 11/0009 232/1 D
2015/0266689 A1 * 9/2015 Hashimoto ..... G07D 11/0006 271/207

(Continued)

FOREIGN PATENT DOCUMENTS

EP 2 736 025 A1 5/2014
GB 2469814 A 11/2010
WO 2012115028 A1 8/2012

*Primary Examiner* — William Miller
(74) *Attorney, Agent, or Firm* — Winston Hsu

(57) ABSTRACT

A banknote cash unit capable of securely sealing an opening of a storage bag is disclosed. The storage bag has a first fixation tab and a second fixation tab. The opening is defined between the first fixation tab and the second fixation tab. The banknote cash unit includes a housing, a banknote inlet unit and a paper sheet storing unit. The banknote inlet unit is disposed on the housing. The paper sheet storing unit is installed in the housing and for holding the storage bag. The paper sheet storing unit includes a first sealing module and a second sealing module disposed next to the first sealing module. When the second fixation tab is closed to the first fixation, the first sealing module generates a first sealing portion and the second sealing module generates a second sealing portion, so as to combine the first fixation tab and the second fixation tab.

21 Claims, 7 Drawing Sheets

(56) References Cited

U.S. PATENT DOCUMENTS

| | | | | |
|---|---|---|---|---|
| 2016/0031574 | A1* | 2/2016 | Razzaboni | B65B 7/02 53/268 |
| 2016/0086415 | A1* | 3/2016 | Razzaboni | G07D 11/0069 232/5 |
| 2016/0098880 | A1* | 4/2016 | Razzaboni | B65B 25/14 53/235 |

* cited by examiner

BANKNOTE CASH UNIT

BACKGROUND OF THE INVENTION

1. Field of the Invention

The present relates to a banknote cash unit, and more particularly, to a banknote cash unit with capability of securely sealing an opening of a storage bag.

2. Description of the Prior Art

A conventional banknote cash unit includes a storage bag for storing introduced banknotes. When the storage bag is full of the banknotes, the banknote cash unit will seal an opening of the storage bag for preventing the banknotes from dropping out from the storage bag via the opening during transportation. However, the introduced banknotes will drag a bag body of the storage bag down, which forces fixation tabs defining the opening therebetween of the storage bag to deform and results in failure of attachment of the fixation tabs when the banknote cash unit seals the opening of the storage bag.

SUMMARY OF THE INVENTION

The prevent invention provides a banknote cash unit with capability of securely sealing an opening of a storage bag for solving above drawbacks.

According to an embodiment of the present invention, a banknote cash unit with capability of securely sealing an opening of a storage bag is disclosed. The storage bag has a first fixation tab and a second fixation tab opposite to and closable relative to the first fixation tab. The opening is defined between the first fixation tab and the second fixation tab. The banknote cash unit includes a housing, a banknote inlet unit and a paper sheet storing unit. The banknote inlet unit is disposed on the housing. The paper sheet storing unit is installed in the housing and for holding the storage bag. The paper sheet storing unit includes a first sealing module and a second sealing module. The second sealing module is disposed next to the first sealing module. When the second fixation tab is closed to the first fixation, the first sealing module generates a first sealing portion and the second sealing module generates a second sealing portion, so as to combine the first fixation tab and the second fixation tab.

According to another embodiment of the present invention, the banknote cash unit further includes a transportation unit disposed inside the housing and for transporting at least one banknote from the banknote inlet unit into the storage bag held by the paper sheet storing unit.

According to another embodiment of the present invention, the paper sheet storing unit further includes a first bag holder and a second bag holder. The first bag holder is installed in the housing and for holding the first fixation tab. The second bag holder is movable relative to the first bag holder and for holding the second fixation tab.

According to another embodiment of the present invention, the first sealing module includes a first cooperating member and a first melting member. The first cooperating member is selectively disposed on one of the first bag holder and the second bag holder. The first melting member is selectively disposed on another one of the first bag holder and the second bag holder. The first melting member is for melting the first fixation tab and the second fixation tab cooperatively with the first cooperating member, so as to generate the first sealing portion.

According to another embodiment of the present invention, the second sealing module includes a second cooperating member and a second melting member. The second cooperating member is selectively disposed on one of the first bag holder and the second bag holder, and the second cooperating member is disposed next to the first cooperating member. The second melting member is selectively disposed on another one of the first bag holder and the second bag holder, and the second melting member is disposed next to the first melting member. The second melting member is for melting the first fixation tab and the second fixation tab cooperatively with the second cooperating member, so as to generate the second sealing portion.

According to another embodiment of the present invention, the first bag holder has at least one first protruding post for engaging with at least one first fixing hole on the first fixation tab, and the second bag holder has at least one second protruding post for engaging with at least one second fixing hole on the second fixation tab.

According to another embodiment of the present invention, the banknote cash unit further includes a holding frame slidably assembled with the housing between a closed position and an open position and for holding the first bag holder and the second bag holder.

According to another embodiment of the present invention, the paper sheet storing unit further includes a holding frame and a lifting member. The holding frame is slidably assembled with the housing between a closed position and an open position. The lifting member is movably installed in the holding frame. The lifting member is moved toward the storage bag, so as to hold a bottom portion of the storage bag.

According to another embodiment of the present invention, the banknote cash unit further includes a transportation unit, a counting unit, a lifting member driving module and a control unit. The transportation unit is disposed inside the housing and for transporting at least one banknote from the banknote inlet unit into the storage bag held by the paper sheet storing unit. The counting unit is disposed inside the housing and for counting a number of the at least one banknote transported by the transportation unit. The lifting member driving module is coupled to the lifting member. The control unit is coupled to the counting unit and the lifting member driving module. The control unit activates the lifting member driving module to lift the lifting member when the number of the at least one banknote counted by the counting unit is over a specific number.

According to another embodiment of the present invention, the paper sheet storing unit further includes a first bag holder and a second bag holder. The first bag holder is installed in the housing and for holding the first fixation tab. The second bag holder is movable relative to the first bag holder and for holding the second fixation tab. The banknote cash unit further includes a bag holder driving module coupled to the second bag holder and for driving the second bag holder to close to the first bag holder.

According to another embodiment of the present invention, a banknote cash unit includes a housing, a banknote inlet unit, a paper sheet storing unit, a holding frame and a lifting member. The banknote inlet unit is disposed on the housing. The paper sheet storing unit is installed in the housing, wherein a storage bag is held by the paper sheet storing unit. The holding frame is slidably assembled with the housing between a closed position and an open position and for holding the paper sheet storing unit. The lifting member is movably installed in the holding frame. The lifting member is moved toward the storage bag, so as to hold a bottom portion of the storage bag.

In summary, the banknote cash unit of the present invention includes two sealing modules, i.e., the first sealing module and the second sealing module, which are capable of generating two different sealing portions, i.e., the first sealing portion and the second sealing portion, so as to double sealing the opening of the storage bag and enhance the attachment of the first fixation tab and the second fixation tab of the storage bag. Furthermore, the banknote cash unit of the present invention further utilizes the lifting member for holding the bottom portion of the storage bag, so as to provide the storage bag with the supporting force which can prevent the storage bag from dragging downwards due to weight of the introduced banknotes. In such a manner, it reduces deformation of the first fixation tab and the second fixation tab of the storage bag and facilitates the following sealing process of the first fixation tab and the second fixation tab.

These and other objectives of the present invention will no doubt become obvious to those of ordinary skill in the art after reading the following detailed description of the preferred embodiment that is illustrated in the various figures and drawings.

DETAILED DESCRIPTION

In the following detailed description of the embodiments, reference is made to the accompanying drawings which form a part hereof, and in which is shown by way of illustration specific embodiments in which the invention may be practiced. In this regard, directional terminology, such as "top," "bottom," etc., is used with reference to the orientation of the Figure(s) being described. The components of the present invention can be positioned in a number of different orientations. As such, the directional terminology is used for purposes of illustration and is in no way limiting. On the other hand, the drawings are only schematic and the sizes of components may be exaggerated for clarity. It is to be understood that other embodiments may be utilized and structural changes may be made without departing from the scope of the present invention. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," and "installed" and variations thereof herein are used broadly and encompass direct and indirect connections and installations. Accordingly, the drawings and descriptions will be regarded as illustrative in nature and not as restrictive.

Figure 1:
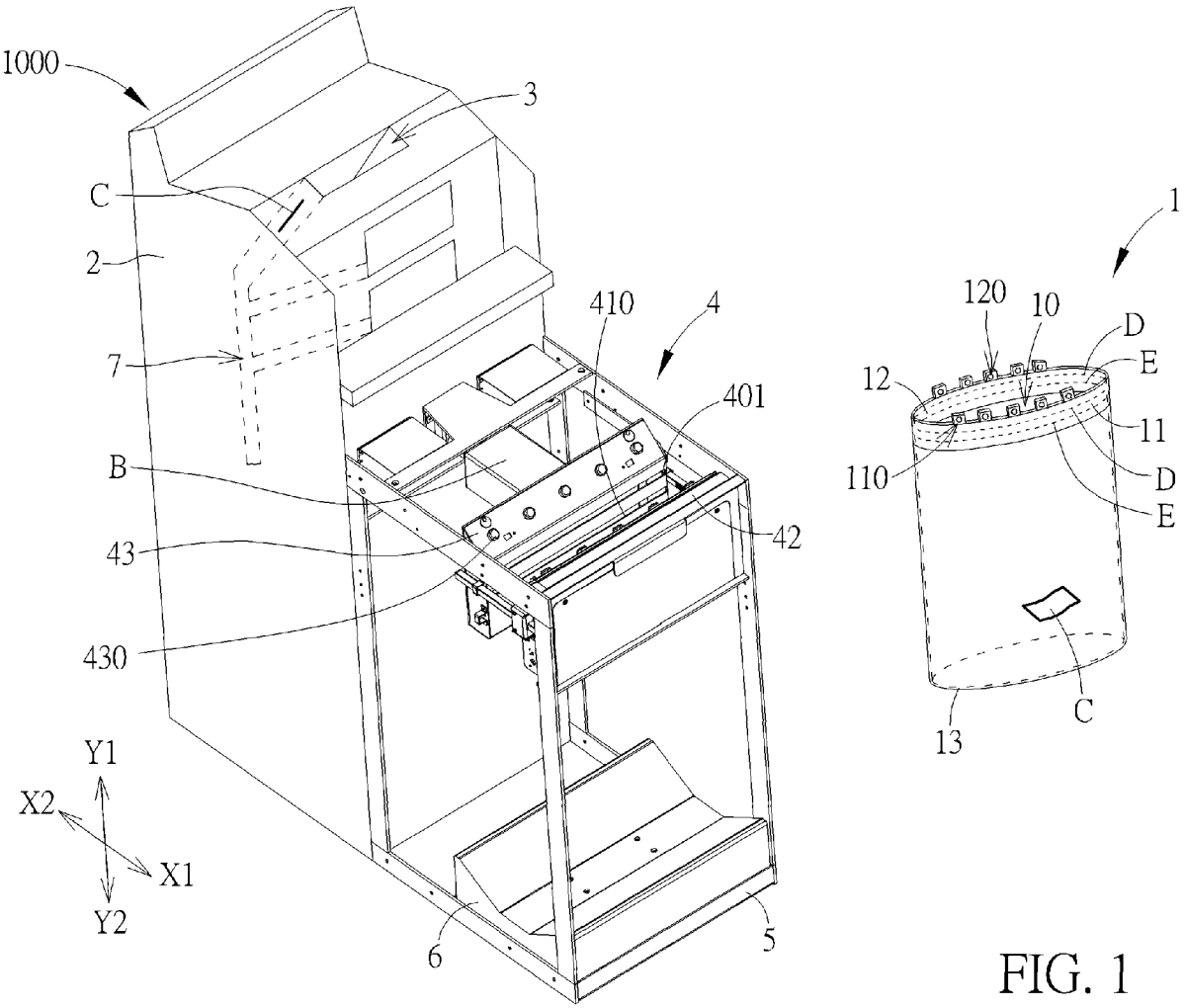
FIG. 1 is a diagram illustrating a banknote cash unit with capability of securely sealing an opening of a storage bag in an open status according to an embodiment of the present invention.

Please refer to FIG. 1. FIG. 1 is a diagram illustrating a banknote cash unit 1000 with capability of securely sealing an opening 10 of a storage bag 1 in an open status according to an embodiment of the present invention. The configuration of the banknote cash unit 1000 will be described with reference to FIG. 1. Generally, a store such as a supermarket is divided into a front area where a store clerk deposits and dispenses cash actually exchanged with a customer and a backyard area where the cash and gods in the front area are managed, one of a plenty of cash settlement units are placed in the front area, and the banknote cash unit 1000 shown in FIG. 1 is placed in the backyard area.

As shown in FIG. 1, the storage bag 1 has a first fixation tab 11 and a second fixation tab 12. The second fixation tab 12 is opposite to and closable relative to the first fixation tab 11, and the opening 10 is defined between the first fixation tab 11 and the second fixation tab 12. The banknote cash unit 1000 includes a housing 2, a banknote inlet unit 3, a paper sheet storing unit 4, a holding frame 5 and a lifting member 6. The banknote inlet unit 3 is disposed on the housing 2. The paper sheet storing unit 4 is installed in the housing 2 and for holding the storage bag 1, i.e., the storage bag 1 is held by the paper sheet storing unit 4.

Figure 2:
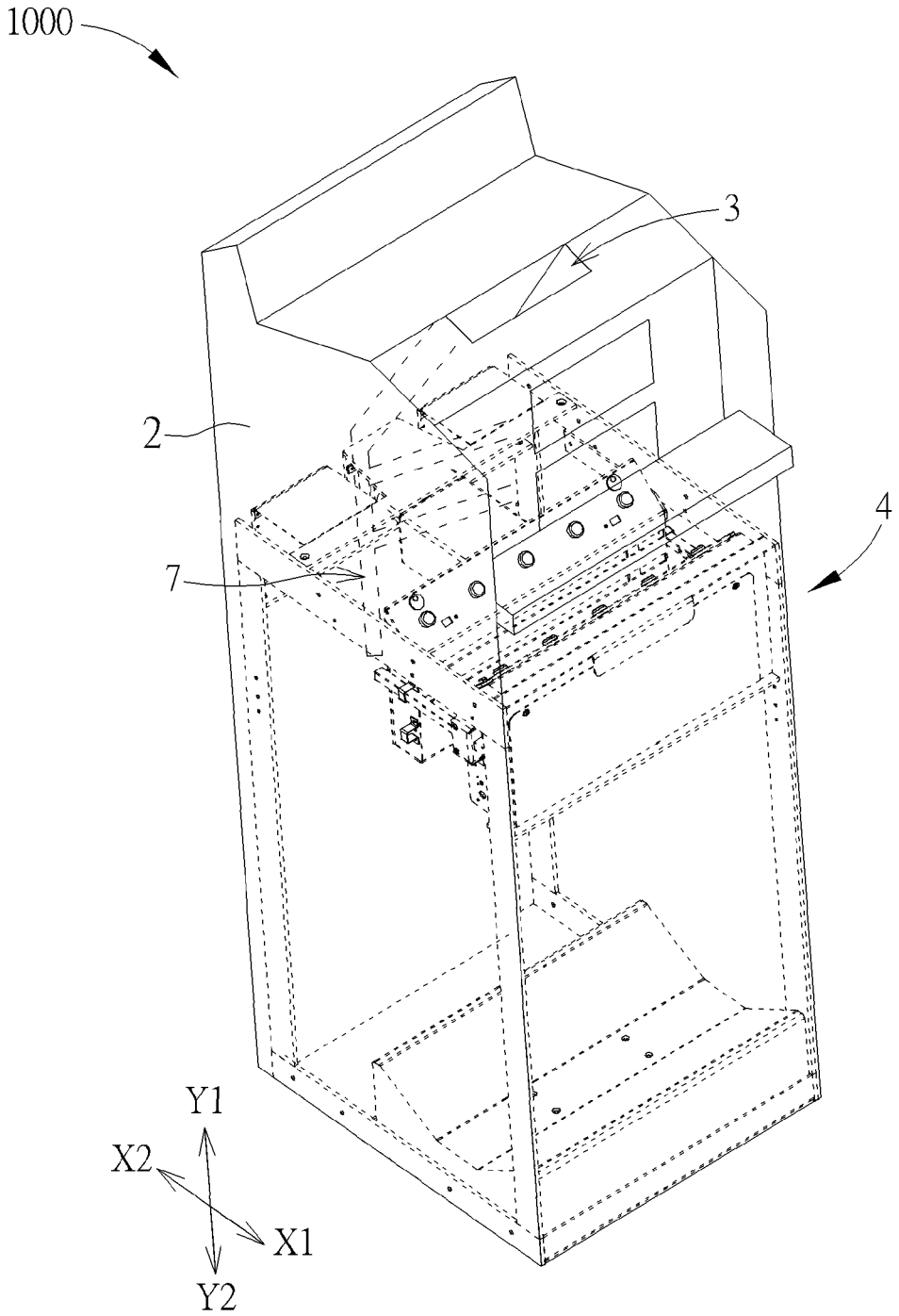
FIG. 2 is a diagram of the banknote cash unit in a closed status according to the embodiment of the present invention.

Please refer to FIG. 1 and FIG. 2. FIG. 2 is a diagram of the banknote cash unit 1000 in a closed status according to the embodiment of the present invention. As shown in FIG. 1 and FIG. 2, the holding frame 5 is slidably assembled with the housing 2 and for holding the paper sheet storing unit 4, i.e., the holding frame 5 is able to slide between an open position as shown in FIG. 1 along a first horizontal direction X1 or and a closed position shown in FIG. 2 along a second horizontal direction X2. In other words, the paper sheet storing unit 4 is able to move with the holding frame 5 between the closed position and the open position with respect to the housing 2.

Furthermore, the lifting member 6 is movably installed in the holding frame 5 and able to move toward the storage bag 1 along a first vertical direction Y1 perpendicular to the first horizontal direction X1 or to the second horizontal direction X2. Alternatively, the lifting member 6 is able to move away from the storage bag 1 along a second vertical direction Y2 opposite to the first vertical direction Y1. In other words, the lifting member 6 is able to move with the holding frame 5 between the closed position and the open position with respect to the housing 2. Besides, the lifting member 6 is able to move toward the storage bag 1 or away from the storage bag 1. In this embodiment, the lifting member 6 and the paper sheet storing unit 4 are respectively disposed on two opposite sides of the holding frame 5.

As shown in FIG. 1 and FIG. 2, the paper sheet storing unit 4 includes a first sealing module 40, a second sealing module 41, a first bag holder 42 and a second bag holder 43. The second sealing module 41 is disposed next to the first sealing module 40. The first bag holder 42 is installed in the housing 2 and for holding the first fixation tab 11 of the storage bag 1. The second bag holder 43 is movable relative to the first bag holder 42 and for holding the second fixation tab 12 of the storage bag 1.

In this embodiment, the first bag holder 42 and the second bag holder 43 are installed in the holding frame 5, i.e., the holding frame 5 holds the first bag holder 42 and the second bag holder 43. In addition, the first bag holder 42 has a plurality of first protruding posts 420 for engaging with a plurality of first fixing holes 110 on the first fixation tab 11 of the storage bag 1, respectively. The second bag holder 43 has a plurality of second protruding posts 430 for engaging with a plurality of second fixing holes 120 on the second fixation tab 12 of the storage bag 1, respectively. As a result, the first bag holder 42 and the second bag holder 43 of the paper sheet storing unit 4 is able to be used for holding the storage bag 1.

It should be noticed that amounts of the first protruding post 420 and the second protruding post 430 are not limited to those illustrated in figures in this embodiment. For example, the first bag holder 42 can have only one first protruding post 420 as well, and the second bag holder 43 can have only one second protruding post 430 as well. In other words, structures that the first bag holder 42 has at least one first protruding post 420 and the second bag holder 43 has at least one second protruding post 430 are within the scope of the present invention.

Figure 3:
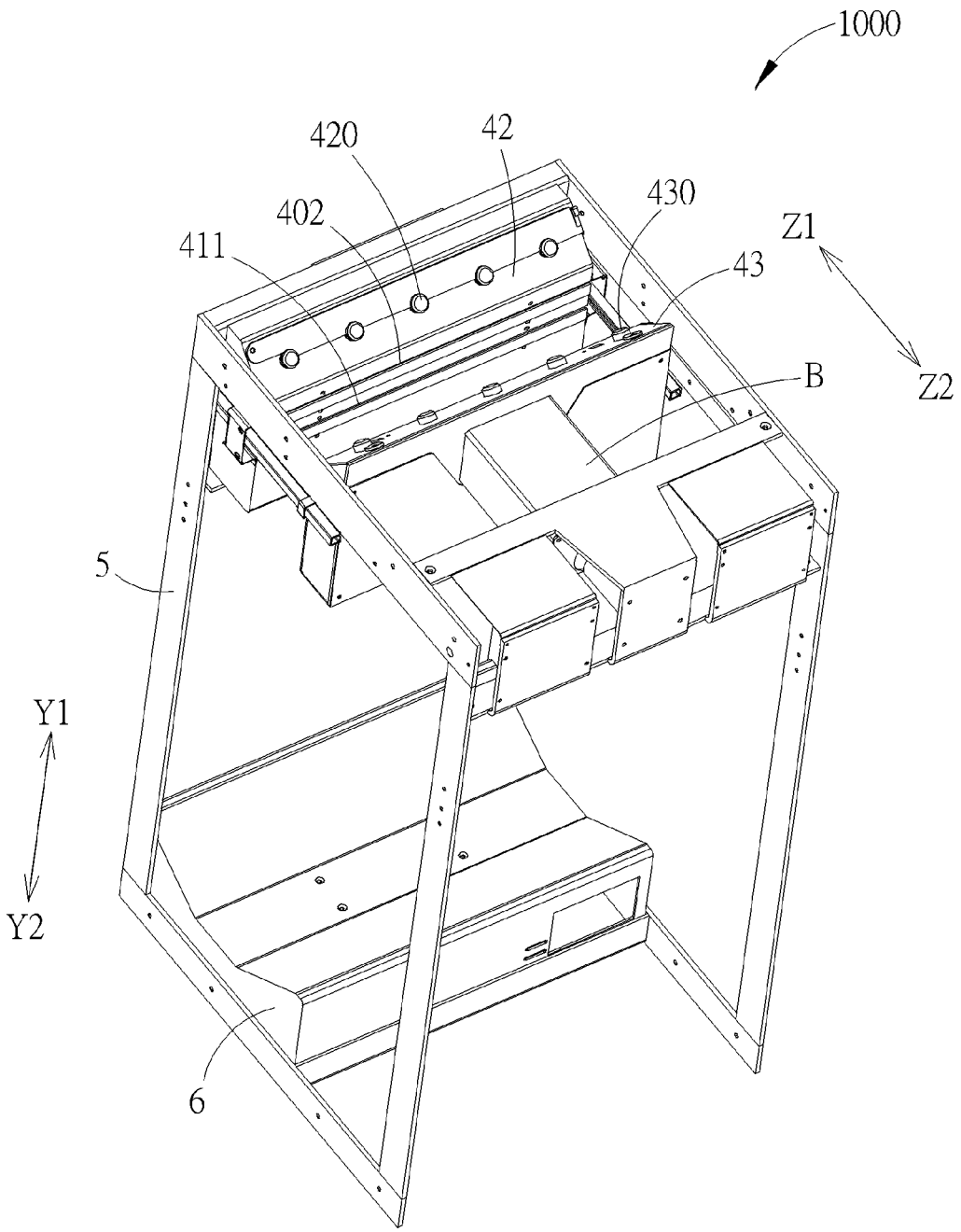
FIG. 3 is a diagram of the banknote cash unit in another view according to the embodiment of the present invention.
Figure 4:
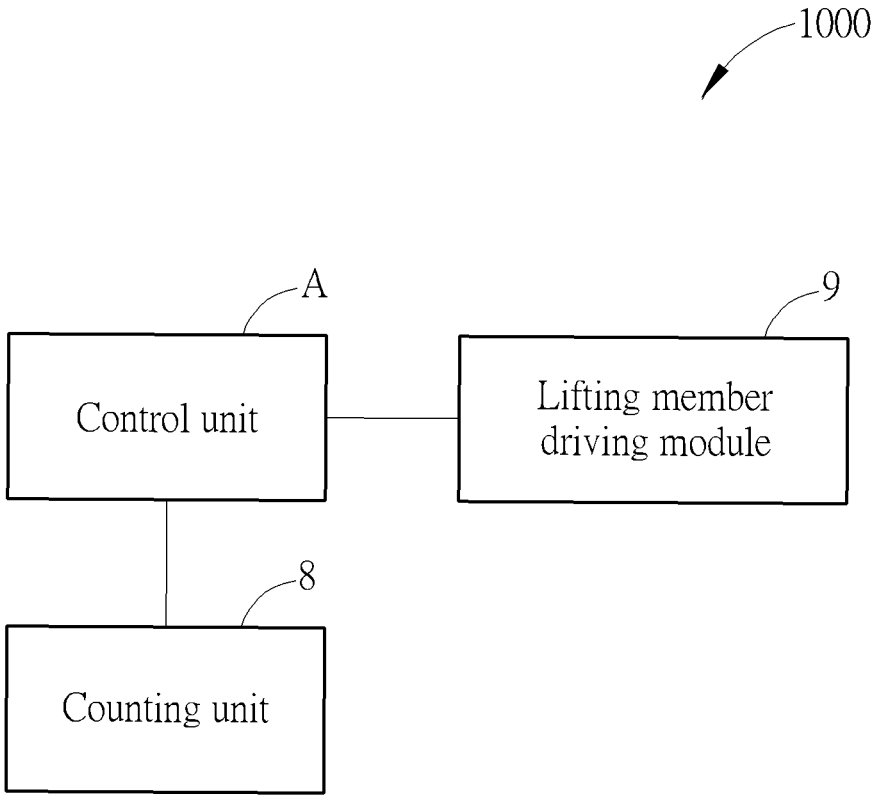
FIG. 4 is a functional block diagram of the banknote cash unit according to the embodiment of the present invention.

Please refer to FIG. 1 to FIG. 4. FIG. 3 is a diagram of the banknote cash unit 1000 in another view according to the embodiment of the present invention. FIG. 4 is a functional block diagram of the banknote cash unit 1000 according to the embodiment of the present invention. As shown in FIG. 1 to FIG. 4, banknote cash unit 1000 further includes a transportation unit 7, a counting unit 8, a lifting member driving module 9, a control unit A and a bag holder driving module B. The transportation unit 7 is disposed inside the housing 2 and for transporting at least one banknote C from the banknote inlet unit 3 into the storage bag 1 held by the paper sheet storing unit 4. The counting unit 8 is disposed inside the housing 2 and for counting a number of the at least one banknote C transported by the transportation unit 7. In practical application, the transportation unit 7 can be a paper path formed by inner structures of the housing 2, such as ribs, lateral walls and so on. The counting unit 8 can be a sensor which is disposed in the paper path, i.e., the transportation unit 7.

Furthermore, the lifting member driving module 9 is coupled to the lifting member 6 and for driving the lifting member 6 to move toward the storage bag 1 along the first vertical direction Y1 or away from the storage bag 1 along the second vertical direction Y2. The control unit A is coupled to the counting unit 8 and the lifting member driving module 9. The bag holder driving module B is coupled to the second bag holder 43. The bag holder driving module B is used for driving the second bag holder 43 to close to the first bag holder 42 along a close direction Z1, or alternatively, the bag holder driving module B is further used for driving the second bag holder 43 to move away from the first bag holder 42 along an open direction Z2 opposite to the close direction Z1.

As shown in FIG. 1, in this embodiment, the close direction Z1 is identical to the first horizontal direction X1, and the open direction Z2 is identical to the second horizontal direction X2, but the present invention is not limited thereto. In this embodiment, the lifting member driving module 9 and the bag holder driving module B can be mechanisms with the same components, and both of which can include a motor, a linkage bar and so on, but the present invention is not limited thereto.

Figure 5:
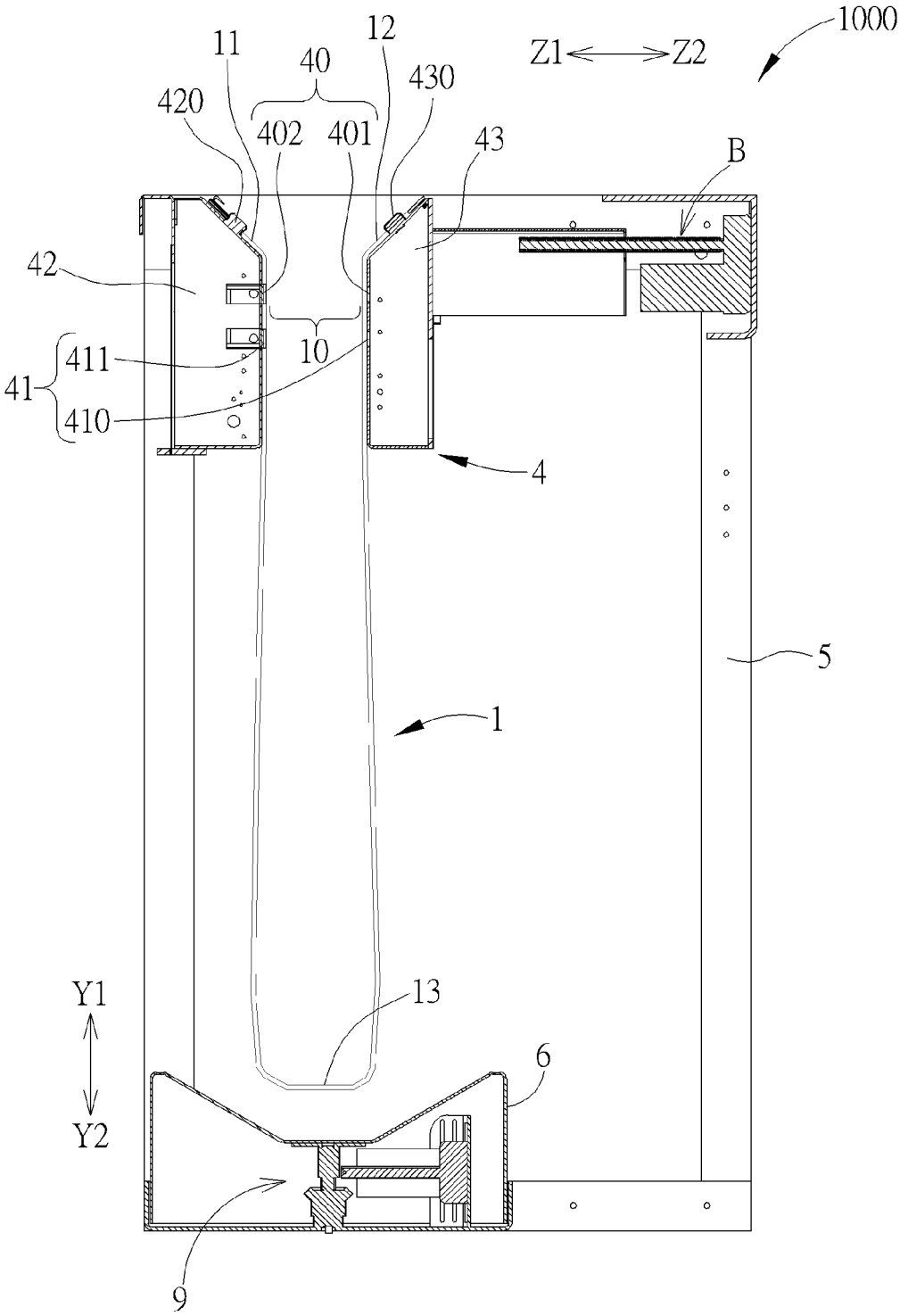
FIG. 5 is a diagram illustrating the banknote cash unit in a first status according to the embodiment of the present invention.
Figure 6:
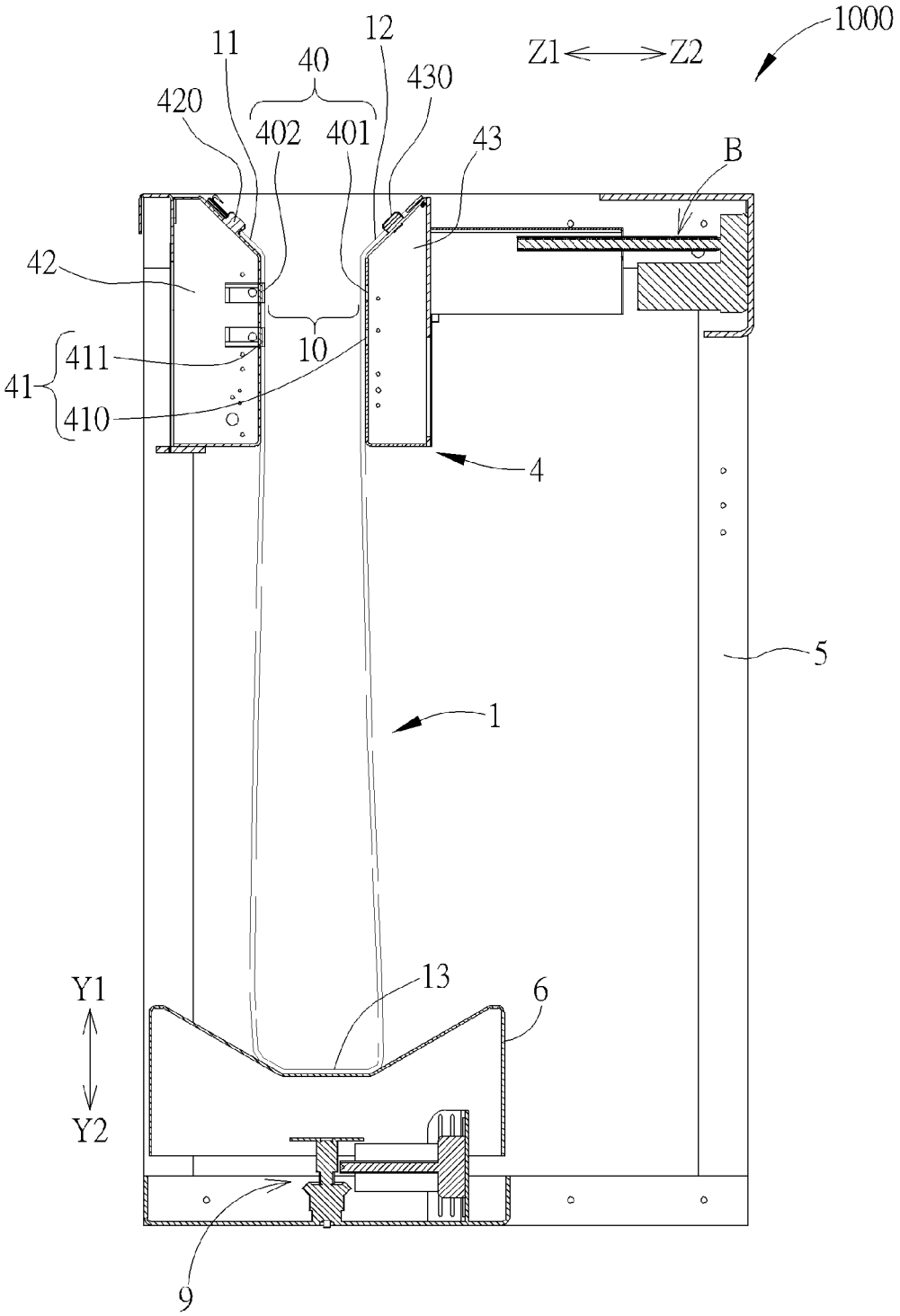
FIG. 6 is a diagram illustrating the banknote cash unit in a second status according to the embodiment of the present invention.
Figure 7:
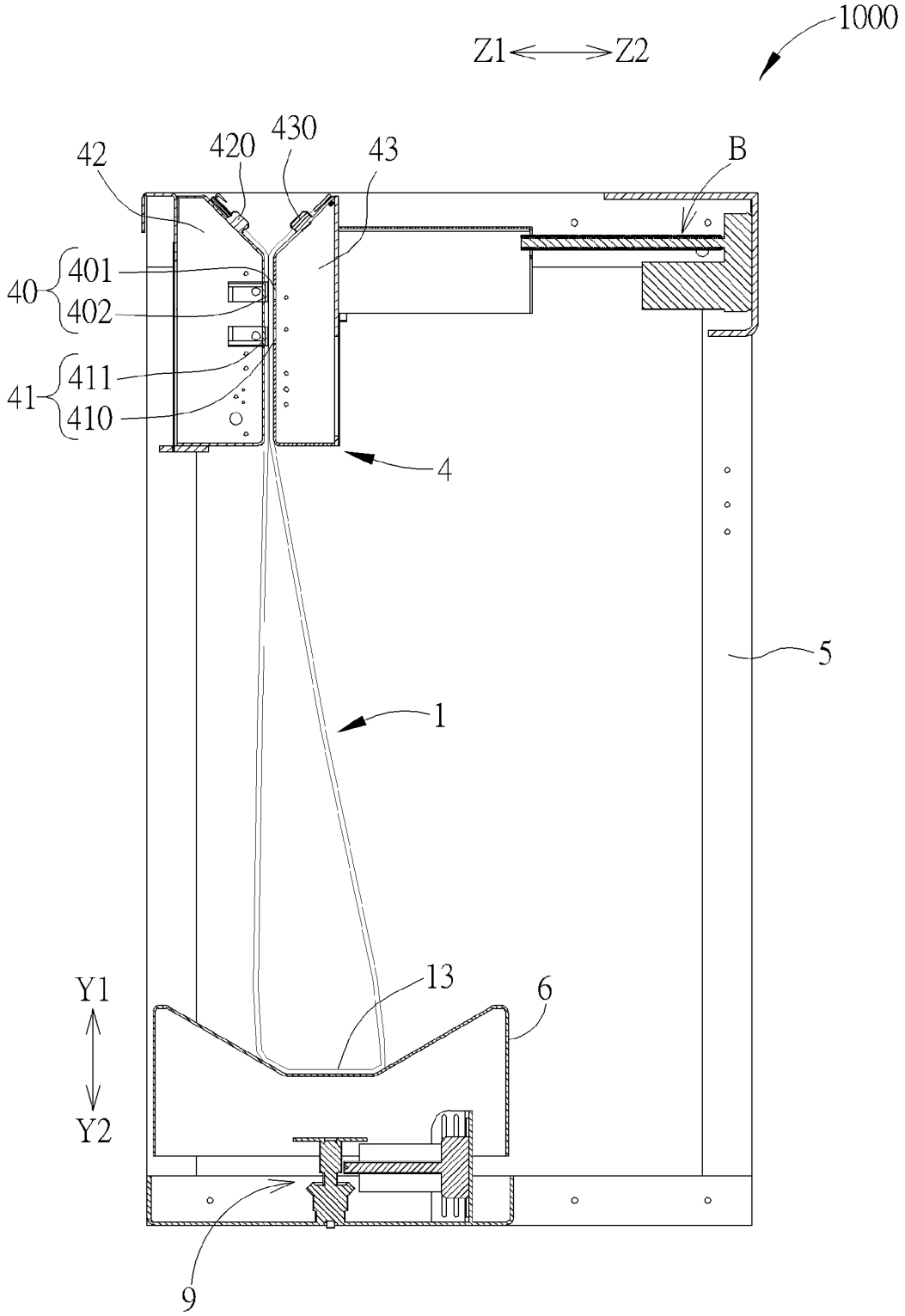
FIG. 7 is a diagram illustrating the banknote cash unit in a third status according to the embodiment of the present invention.

Please refer to FIG. 1 and FIG. 4 to FIG. 7. FIG. 5 is a diagram illustrating the banknote cash unit 1000 in a first status according to the embodiment of the present invention. FIG. 6 is a diagram illustrating the banknote cash unit 1000 in a second status according to the embodiment of the present invention. FIG. 7 is a diagram illustrating the banknote cash unit 1000 in a third status according to the embodiment of the present invention. When the banknote cash unit 1000 is in the first status shown in FIG. 5, the banknotes C are transported via the transportation unit 7 from the banknote inlet unit 3 to the storage bag 1. Meanwhile, the counting unit 8 counts the number of the banknotes C transported by the transportation unit 7.

When the number of the banknotes C counted by the counting unit 8 is over a specific number, the control unit A activates the lifting member driving module 9 to lift the lifting member 6, meanwhile, the lifting member 6 is driven by the lifting member driving module 9 and moves toward the storage bag 1 from a position shown in FIG. 5 to a position shown in FIG. 6 along the first vertical direction Y1. Accordingly, the lifting member 6 is able to hold a bottom portion 13 of the storage bag 1, so as to provide the storage bag 1 with a supporting force which can prevent the storage bag 1 from dragging downwards due to weight of the introduced banknotes C. In such a manner, it reduces deformation of the first fixation tab 11 and the second fixation tab 12 of the storage bag 1 and facilitates the following sealing process of the first fixation tab 11 and the second fixation tab 12.

When the whole process of the banknote C transported into the storage bag 1 is done, the control unit A further activates the bag holder driving module B to move the second bag holder 43 toward the first bag holder 42 along the close direction Z1 from the position shown in FIG. 6 to a position shown in FIG. 7. In the meanwhile, the second bag holder 43 is driven to be close to the first bag holder 42 by the bag holder driving module B, so as to activate the second fixation tab 12 of the storage bag 1 to be closed to the first fixation tab 11. When the second fixation tab 12 is closed to the first fixation tab 11, the banknote cash unit 1000 of the present invention utilizes the first sealing module 40 of the paper sheet storing unit 4 for generating a first sealing portion D for combining the first fixation tab 11 and the second fixation tab 12 of the storage bag 1. In addition, the banknote cash unit 1000 of the present invention further utilizes the second sealing module 41 of the paper sheet storing unit 4 for generating a second sealing portion E next to the first sealing portion D for combining the first fixation tab 11 and the second fixation tab 12 of the storage bag 1.

In other words, the banknote cash unit 1000 of the present invention includes two sealing modules, i.e., the first sealing module 40 and the second sealing module 41, which are capable of generating two different sealing portions, i.e., the first sealing portion D and the second sealing portion E, so as to double sealing the opening 10 of the storage bag 1 and enhance attachment of the first fixation tab 11 and the second fixation tab 12 of the storage bag 1.

In this embodiment, the first sealing module 40 includes a first cooperating member 401 and a first melting member 402, and the second sealing module 41 includes a second cooperating member 410 and a second melting member 411. In this embodiment, the first melting member 402 and the second melting member 411 are disposed on the same bag holder, i.e., the first bag holder 42, and the first cooperating member 401 and the second cooperating member 410 are disposed on the same bag holder, i.e., the second bag holder 43, but the present invention is not limited thereto. For example, the first melting member 402 and the second melting member 411 can be respectively disposed on the first bag holder 42 and the second bag holder 43 as well, and the first cooperating member 401 and the second cooperating member 410 can be respectively disposed on the first bag holder 42 and the second bag holder 43 as well. In other words, structures that the first cooperating member 401 is selectively disposed on one of the first bag holder 42 and the second bag holder 43 and the first melting member 402 is selectively disposed on another one of the first bag holder 42 and the second bag holder 43 and structures the second cooperating member 410 is selectively disposed on one of the first bag holder 42 and the second bag holder 43 and the second melting member 411 is selectively disposed on another one of the first bag holder 42 and the second bag holder 43 are within the scope of the present invention. As for which one of above-mentioned designs is adopted, it depends on practical demands.

As mentioned above, when the second fixation tab 12 is closed to the first fixation tab 11, the first melting member 402 is for melting the first fixation tab 11 and the second fixation tab 12 cooperatively with the first cooperating member 401 in an impulse melting manner, so as to generate the first sealing portion D, and the second melting member 411 is for melting the first fixation tab 11 and the second fixation tab 12 cooperatively with the second cooperating member 410 in an impulse melting manner, so as to generate the second sealing portion E. In such a manner, the first sealing module 40 and the second sealing module 41 can generate two different sealing portions for the storage bag 1 for enhancing the attachment of the first fixation tab 11 and the second fixation tab 12 of the storage bag 1.

Compared to the prior art, the banknote cash unit of the present invention includes two sealing modules, i.e., the first sealing module and the second sealing module, which are capable of generating two different sealing portions, i.e., the first sealing portion and the second sealing portion, so as to double sealing the opening of the storage bag and enhance the attachment of the first fixation tab and the second fixation tab of the storage bag. Furthermore, the banknote cash unit of the present invention further utilizes the lifting member for holding the bottom portion of the storage bag, so as to provide the storage bag with the supporting force which can prevent the storage bag from dragging downwards due to weight of the introduced banknotes. In such a manner, it reduces deformation of the first fixation tab and the second fixation tab of the storage bag and facilitates the following sealing process of the first fixation tab and the second fixation tab.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A banknote cash unit with capability of securely sealing an opening of a storage bag, the storage bag having a first fixation tab and a second fixation tab opposite to and closable relative to the first fixation tab, the opening being defined between the first fixation tab and the second fixation tab, the banknote cash unit comprising:

a housing;

a banknote inlet unit disposed on the housing; and a paper sheet storing unit installed in the housing and for holding the storage bag, comprising:

a first sealing module; and a second sealing module disposed next to the first sealing module, when the second fixation tab is closed to the first fixation tab, the first sealing module generating a first sealing portion and the second sealing module generating a second sealing portion, the first sealing portion contacting the first fixation tab and the second fixation tab, and the second sealing portion contacting the first fixation tab and the second fixation tab, so as to combine the first fixation tab and the second fixation tab.

2. The banknote cash unit of claim 1, further comprising:

a transportation unit disposed inside the housing and for transporting at least one banknote from the banknote inlet unit into the storage bag held by the paper sheet storing unit.

3. The banknote cash unit of claim 1, wherein the paper sheet storing unit further comprises:

a first bag holder installed in the housing and for holding the first fixation tab; and a second bag holder movable relative to the first bag holder and for holding the second fixation tab.

4. The banknote cash unit of claim 3, wherein the first sealing module comprises:

a first cooperating member selectively disposed on one of the first bag holder and the second bag holder; and a first melting member selectively disposed on another one of the first bag holder and the second bag holder, the first melting member being for melting the first fixation tab and the second fixation tab cooperatively with the first cooperating member, so as to generate the first sealing portion.

5. The banknote cash unit of claim 4, wherein the second sealing module comprises:

a second cooperating member selectively disposed on one of the first bag holder and the second bag holder, the second cooperating member being disposed next to the first cooperating member; and a second melting member selectively disposed on another one of the first bag holder and the second bag holder, the second melting member being disposed next to the first melting member, the second melting member being for melting the first fixation tab and the second fixation tab cooperatively with the second cooperating member, so as to generate the second sealing portion.

6. The banknote cash unit of claim 3, wherein the first bag holder has at least one first protruding post for engaging with at least one first fixing hole on the first fixation tab, and the second bag holder has at least one second protruding post for engaging with at least one second fixing hole on the second fixation tab.

7. The banknote cash unit of claim 3, further comprising:

a holding frame slidably assembled with the housing between a closed position and an open position and for holding the first bag holder and the second bag holder.

8. The banknote cash unit of claim 1, wherein the paper sheet storing unit further comprises:

a holding frame slidably assembled with the housing between a closed position and an open position; and a lifting member movably installed in the holding frame, the lifting member being moved toward the storage bag, so as to hold a bottom portion of the storage bag.

9. The banknote cash unit of claim 8, further comprising:

a transportation unit disposed inside the housing and for transporting at least one banknote from the banknote inlet unit into the storage bag held by the paper sheet storing unit;

a counting unit disposed inside the housing and for counting a number of the at least one banknote transported by the transportation unit;

a lifting member driving module coupled to the lifting member; and a control unit coupled to the counting unit and the lifting member driving module, the control unit activating the lifting member driving module to lift the lifting member when the number of the at least one banknote counted by the counting unit is over a specific number.

10. The banknote cash unit of claim 1, wherein the paper sheet storing unit further comprises a first bag holder and a second bag holder, the first bag holder is installed in the housing and for holding the first fixation tab, the second bag holder is movable relative to the first bag holder and for holding the second fixation tab, and the banknote cash unit further comprises:

a bag holder driving module coupled to the second bag holder and for driving the second bag holder to close to the first bag holder.

11. A banknote cash unit, comprising:

a housing;

a banknote inlet unit disposed on the housing;

a paper sheet storing unit installed in the housing, wherein a storage bag is held by the paper sheet storing unit;

a holding frame slidably assembled with the housing between a closed position and an open position and for holding the paper sheet storing unit; and a lifting member movably installed in the holding frame, the lifting member being moved toward the storage bag, so as to hold a bottom portion of the storage bag.

12. The banknote cash unit of claim 11, further comprising:

a transportation unit disposed inside the housing and for transporting at least one banknote from the banknote inlet unit into the storage bag held by the paper sheet storing unit;

a counting unit disposed inside the housing and for counting a number of the at least one banknote transported by the transportation unit;

a lifting member driving module coupled to the lifting member; and a control unit coupled to the counting unit and the lifting member driving module, the control unit activating the lifting member driving module to lift the lifting member when the number of the at least one banknote counted by the counting unit is over a specific number.

13. The banknote cash unit of claim 11, wherein the storage bag has a first fixation tab and a second fixation tab, an opening is defined between the first fixation tab and the second fixation tab, and the paper sheet storing unit comprises:

a first bag holder installed in the housing and for holding the first fixation tab;

a second bag holder movable relative to the first bag holder and for holding the second fixation tab;

a first sealing module coupled with the first bag holder and the second bag holder; and a second sealing module coupled with the first bag holder and the second bag holder and, the second sealing member being disposed next to the first sealing module, when the second bag holder closes to the first bag holder, the first sealing module generating a first sealing portion and the second sealing module generating a second sealing portion, so as to combine the first fixation tab and the second fixation tab.

14. The banknote cash unit of claim 13, further comprising:

a transportation unit disposed inside the housing and for transporting at least one banknote from the banknote inlet unit into the storage bag held by the paper sheet storing unit.

15. The banknote cash unit of claim 13, wherein the first sealing module comprises:

a first cooperating member selectively disposed on one of the first bag holder and the second bag holder; and a first melting member selectively disposed on another one of the first bag holder and the second bag holder, the first melting member being for melting the first fixation tab and the second fixation tab cooperatively with the first cooperating member, so as to generate the first sealing portion.

16. The banknote cash unit of claim 15, wherein the second sealing module comprises:

a second cooperating member selectively disposed on one of the first bag holder and the second bag holder, the second cooperating member being disposed next to the first cooperating member; and a second melting member selectively disposed on another one of the first bag holder and the second bag holder, the second melting member being disposed next to the first melting member, the second melting member being for melting the first fixation tab and the second fixation tab cooperatively with the second cooperating member, so as to generate the second sealing portion.

17. The banknote cash unit of claim 13, wherein the first bag holder has at least one first protruding post for engaging with at least one first fixing hole on the first fixation tab, and the second bag holder has at least one second protruding post for engaging with at least one second fixing hole on the second fixation tab.

18. The banknote cash unit of claim 13, further comprising:

a bag holder driving module coupled to the second bag holder and for driving the second bag holder to close to the first bag holder.

19. A banknote cash unit with capability of securely sealing an opening of a storage bag, the storage bag having a first fixation tab and a second fixation tab opposite to and closable relative to the first fixation tab, the opening being defined between the first fixation tab and the second fixation tab, the banknote cash unit comprising:

a housing;

a banknote inlet unit disposed on the housing; and a paper sheet storing unit installed in the housing and for holding the storage bag, comprising:

a first sealing module;

a second sealing module disposed next to the first sealing module, when the second fixation tab is closed to the first fixation tab, the first sealing module generating a first sealing portion and the second sealing module generating a second sealing portion, so as to combine the first fixation tab and the second fixation tab;

a holding frame slidably assembled with the housing between a closed position and an open position; and a lifting member movably installed in the holding frame, the lifting member being moved toward the storage bag, so as to hold a bottom portion of the storage bag.

20. The banknote cash unit of claim 19, further comprising:

a transportation unit disposed inside the housing and for transporting at least one banknote from the banknote inlet unit into the storage bag held by the paper sheet storing unit;

a counting unit disposed inside the housing and for counting a number of the at least one banknote transported by the transportation unit;

a lifting member driving module coupled to the lifting member; and a control unit coupled to the counting unit and the lifting member driving module, the control unit activating the lifting member driving module to lift the lifting member when the number of the at least one banknote counted by the counting unit is over a specific number.

21. A banknote cash unit with capability of securely sealing an opening of a storage bag, the storage bag having a first fixation tab and a second fixation tab opposite to and closable relative to the first fixation tab, the opening being defined between the first fixation tab and the second fixation tab, the banknote cash unit comprising:

a housing;

a banknote inlet unit disposed on the housing;

a paper sheet storing unit installed in the housing and for holding the storage bag, comprising:

a first sealing module;

a second sealing module disposed next to the first sealing module, when the second fixation tab is closed to the first fixation tab, the first sealing module generating a first sealing portion and the second sealing module generating a second sealing portion, so as to combine the first fixation tab and the second fixation tab;

a first bag holder installed in the housing and for holding the first fixation tab; and a second bag holder movable relative to the first bag holder and for holding the second fixation tab; and a holding frame slidably assembled with the housing between a closed position and an open position and for holding the first bag holder and the second bag holder.

* * * * *